US007669659B1

(12) United States Patent
Lugo

(10) Patent No.: US 7,669,659 B1
(45) Date of Patent: Mar. 2, 2010

(54) SYSTEM FOR PREVENTING HYDRATE FORMATION IN CHEMICAL INJECTION PIPING FOR SUBSEA HYDROCARBON PRODUCTION

(76) Inventor: Mario R. Lugo, 719 Sawdust Rd., Suite 201, Spring, TX (US) 77380

( * ) Notice: Subject to any disclaimer, the term of this patent is extended or adjusted under 35 U.S.C. 154(b) by 0 days.

(21) Appl. No.: 12/022,120

(22) Filed: Jan. 29, 2008

(51) Int. Cl.
*E21B 29/12* (2006.01)
*E21B 36/00* (2006.01)

(52) U.S. Cl. ..... 166/345; 166/61; 166/302; 166/272.1; 137/155

(58) Field of Classification Search ..... 166/270, 166/344, 367, 57, 61, 302, 272.1, 345, 266; 137/155
See application file for complete search history.

(56) References Cited

U.S. PATENT DOCUMENTS 2,217,749 A * 10/1940 Hewitt ..... 166/266
2,911,047 A * 11/1959 Henderson ..... 166/61
3,062,289 A * 11/1962 Eades ..... 166/61
4,979,296 A 12/1990 Langner et al.
5,458,691 A 10/1995 Daniels
5,639,313 A * 6/1997 Khalil ..... 134/18
5,824,160 A * 10/1998 Khalil et al. ..... 134/5
5,891,262 A * 4/1999 Khalil et al. ..... 134/22.11
6,035,933 A * 3/2000 Khalil et al. ..... 166/263
6,253,855 B1 * 7/2001 Johal et al. ..... 166/367
6,371,693 B1 * 4/2002 Kopp et al. ..... 405/158
6,536,528 B1 * 3/2003 Amin et al. ..... 166/369
6,663,361 B2 12/2003 Kohl et al.
6,745,838 B2 6/2004 Watson
6,752,214 B2 * 6/2004 Amin et al. ..... 166/369
6,772,840 B2 * 8/2004 Headworth ..... 166/302
6,776,227 B2 * 8/2004 Beida et al. ..... 166/61
6,901,968 B2 6/2005 Thomson
6,939,082 B1 * 9/2005 Baugh ..... 405/145
7,032,658 B2 * 4/2006 Chitwood et al. ..... 166/61
7,036,596 B2 * 5/2006 Reid ..... 166/302
7,311,151 B2 * 12/2007 Chitwood et al. ..... 166/367
7,367,398 B2 * 5/2008 Chiesa et al. ..... 166/302
7,568,526 B2 * 8/2009 de St. Remey et al. ..... 166/302
2003/0170077 A1 * 9/2003 Herd et al. ..... 405/224.2
2005/0072574 A1 * 4/2005 Appleford et al. ..... 166/366
2006/0115332 A1 * 6/2006 Abney et al. ..... 405/169
2007/0284108 A1 * 12/2007 Roes et al. ..... 166/302
2009/0020288 A1 * 1/2009 Balkanyi et al. ..... 166/302

* cited by examiner

*Primary Examiner*—Thomas A Beach
(74) *Attorney, Agent, or Firm*—Egbert Law Offices PLLC

(57) ABSTRACT

A system for prevention of hydrate formation has a manifold, a production piping communicating with the manifold, a chemical injection line positioned in heat exchange relationship along the production piping, and a fluid delivery system connected to the chemical injection line for passing a heated fluid through at least a portion of the chemical injection line. The chemical injection line has a first portion affixed to a surface of the production piping and a second portion extending outwardly therefrom. The fluid delivery system is in communication with the second portion of the chemical injection line. The chemical injection line extends in a U-shaped pattern or in a spiral pattern around an outer surface of the production piping.

16 Claims, 2 Drawing Sheets

SYSTEM FOR PREVENTING HYDRATE FORMATION IN CHEMICAL INJECTION PIPING FOR SUBSEA HYDROCARBON PRODUCTION

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to subsea hydrocarbon production. More particularly, the present invention relates to chemical injection piping as used in such subsea applications. Additionally, the present invention relates to a system for routing the chemical injection piping for the purpose of preventing hydrate formation in such chemical injection lines.

2. Description of Related Art Including Information Disclosed Under 37 CFR 1.97 and 37 CFR 1.98

In the art and science of recovering hydrocarbons for reservoirs beneath water, such as offshore drilling platforms and other subsea operations, it is necessary to inject chemicals into the well, wellbore, and manifolds associated therewith. Such treatment chemicals may include, but are not necessarily limited to, corrosion inhibitors, scale inhibitors, paraffin inhibitors, hydrate inhibitors, demulsifiers, and mixtures thereof. Chemical injection piping is also used in such offshore subsea applications to deliver a specific chemical to piping in subsea trees, manifolds and/or jumpers. Periodically, this chemical injection piping experiences blockages that prohibit the operator from delivering the specific chemicals. These blockages occur when produced hydrocarbons contaminate the chemical injection piping and create hydrates and/or precipitate blockages.

Whenever such blockages occur, extensive remediation efforts are required. In certain circumstances, heating elements are applied around such chemical injection piping so as to elevate the temperature of the hydrate so as to remove the blockages. The application of heat in these areas is a time consuming and difficult operation. In other circumstances, these heating techniques are ineffective in removing the blockages.

Importantly, most of the chemical injection piping extends away from the production piping associated with the manifold in such offshore subsea applications. The extension of such chemical injection piping through the cold temperature of the water associated with such offshore subsea applications will create further difficulties with hydrate formation. Often, the chemicals will need to be pumped at an elevated rate in order to avoid hydrate formation. This pressure may be in excess of the requirements necessary for effectively operating the system.

In other circumstances, the chemical injection piping will need to be removed and replaced in order to effectively remove the blockages. Under such circumstances, the production of hydrocarbons is stopped so that the repair operations can occur. This is a very costly problem for the operator of the well. As such, a need has developed so as to effectively prevent hydrate formation and blockages in chemical injection piping associated with the offshore subsea applications.

In the past, various patents have been issued relating to chemical injection piping. For example, U.S. Pat. No. 6,901,968, issued on Jun. 7, 2005 to F. H. Thomson, teaches a fluid conduit for use in the transportation of chemicals in such subsea offshore applications. The conduit comprises a flexible fluid hose encapsulated by at least one metallized layer which is formed and arranged to minimize permeation of a fluid being transported in the fluid hose. The fluid hoses have differing levels of encapsulation and, thereby permeation, along a given length according to the operational requirements of the fluid conduit/umbilical.

U.S. Pat. No. 6,663,361, issued on Dec. 16, 2003 to Kohl et al., teaches a chemical injection pump for injecting chemicals into a subsea system at depths up to 10,000 feet. The pump generates low pressures and low fluid volumes.

U.S. Pat. No. 4,979,296, issued on Dec. 25, 1990 to Langner et al., shows a flowline bundle that is twisted or braided into a permanent rope-like helical configuration. The helical flowline bundle includes a pipe twist head and a series of pipe tumblers alternating with intermediate pipe supports. The apparatus rotates and translates part of a flowline bundle while simply translating the other part.

U.S. Pat. No. 5,458,691, issued on Oct. 17, 1995 to C. K. Daniels, shows a method and apparatus for flushing fluid through the interstices of subsea umbilicals. A housing is installed in an opened end of the core with the flushing fluid introduced therein, the core elements pass through the housing. In a free-flooding umbilical installation, the flushing fluid may be gravity drained from the top of the umbilical. In other applications, the flushing fluid may be introduced under pressure.

U.S. Pat. No. 6,745,838, issued on Jun. 8, 2004 R. R. Watson, shows a chemical injection system and method for multiple wells so as to control the distribution of chemical fluid from a supply conduit into an individual petroleum well at an adjustable rate. The system includes a remotely operated two position control valve connected to the supply conduit. A cylinder having a cylinder bore with first input-output port, and a second input-output port is also provided. A fluid barrier is located within the cylinder bore such that chemical fluid flows from the supply conduit through the control valve to one end of the cylinder bore and forces the barrier to displace a fixed volume of fluid. Each operation of the directional control valve reverses travel direction of the barrier within the cylinder bore and injects another fixed quantity of fluid into the well.

It is an object of the present invention to provide a system for preventing hydrate formation in chemical injection piping.

It is another object of the present invention to provide a system that is simple to manufacture and easy to install.

It is a further object of the present invention to provide a system which effectively traps unwanted hydrocarbons by creating high and low points in the chemical injection piping.

It is still another object of the present invention to provide a system that can effectively remediate the effects of any blockages that occur in the chemical injection piping These and other objects and advantages of the present invention will become apparent from a reading of the attached specification and appended claims.

BRIEF SUMMARY OF THE INVENTION

The present invention is a system for prevention of hydrate formation that comprises a manifold, a production piping communicating with the manifold, a chemical injection line positioned in heat exchange relationship along the production piping, and a fluid delivery means connected to the chemical injection line for passing a heated fluid through at least a portion of the chemical injection line.

In the present invention, the chemical injection line has a first portion affixed to a surface of the production piping and a second portion extending outwardly of the production piping. The fluid delivery means communicates with the second portion of the chemical injection line.

The fluid delivery means includes a receptacle suitable for connection with a hot stab of a remotely operated vehicle (ROV), a first conduit communicating with the second portion of the chemical injection line at an area adjacent the production piping, and a second conduit communicating with the second portion of the chemical injection line at a position away from the first conduit. The first conduit extends from the receptacle. The second conduit also extends to the receptacle. The second portion extends to a junction plate. The second portion has insulation extending thereover.

In the preferred embodiment of the present invention, the chemical injection line extends in a U-shaped pattern over a top surface of the production piping so as to define an elevated portion at the top surface and a lower portion extending downwardly from the top surface. The chemical injection line has an end opposite to the fluid delivery means that is connected to a valve adjacent to the manifold. In an alternative embodiment of the present invention, the chemical injection line extends in a spiral pattern around the production piping.

An insulation material extends over the production piping and the chemical injection line.

DETAILED DESCRIPTION OF THE INVENTION

Figure 1:
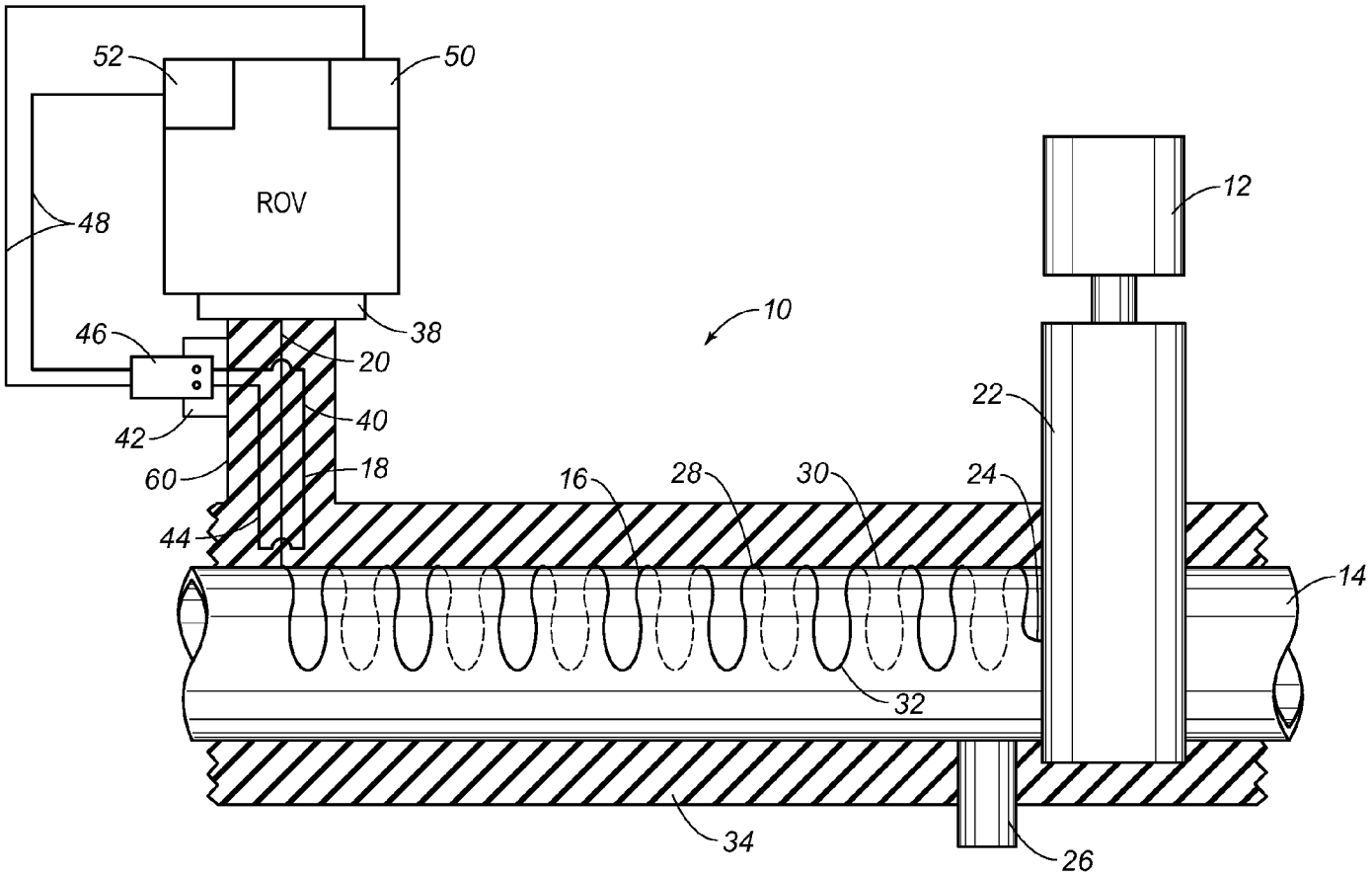
FIG. 1 is a partially diagrammatic side elevational view of the system for preventing hydrate formation in accordance with the teachings of the present invention.

Referring to FIG. 1, there is shown the system 10 for prevention of hydrate formation in accordance with the preferred embodiment of the present invention. The system 10 includes a manifold 12, a production piping 14, a chemical injection line 16 and a fluid delivery means 18. The production piping 14 communicates with the manifold 12. The chemical injection line 16 is positioned in heat exchange relationship along the production piping 14. The fluid delivery means 18 is connected to a portion 20 of the chemical injection line 16 so as to pass a heated fluid through at least this portion 20 of the chemical injection line 16.

As can be seen in FIG. 1, a valving system 22 connects the production piping 14 to the manifold 12. The chemical injection line 16 has an end 24 which will communicate with the manifold 12 through the valve 22. In typical use, the production piping 14 will pass warm hydrocarbons through the valve 22 to the manifold 12 in a conventional manner. A port 26 is provided along the production piping 16 for the injection of chemicals into the interior of the production piping 14. The production piping 14 is a longitudinal section of pipe that extends for a considerable length.

As can be seen in FIG. 1, the chemical injection line 16 extends around the outer surface of the production piping 14. The chemical injection line 16 is typically half-inch to two-inch tubing. The chemical injection line 16 is formed by bending the tubing into an inverted U-shape that semi-wraps around the production piping 14. In particular, the chemical injection line 16 includes an elevated portion 28 positioned generally adjacent to the top surface 30 of the production piping 14. The chemical injection line 16 also includes a lower portion 32 which extends downwardly from the top surface 30 of the production piping 14. This U-shape of the chemical injection line 16 allows for simpler manufacturing and insulation procedures. It is only necessary to place the chemical injection line 16 directly over the top surface 30 of the production piping 14. The relationship of the elevated portion 28 and the lower portion 32 serves to create high and low points for the trapping of unwanted hydrocarbons in the nature of a series of P-traps. This prevents excessive gas migration into the umbilical system. Check valves can also be utilized along the chemical injection line 16 so as to help meditate against hydrocarbon migration.

An insulation material 34 is wrapped around the outer surface of the production piping 14 and over the chemical injection line 16. As such, the insulation material 34 will prevent any loss of heat caused by contact with the cool temperatures of the water.

By situating the chemical injection line 16 in heat exchange relationship with the outer surface of the production piping 14, any heat from the process fluid serves to prevent or remediate any hydrate formation in the chemical injection line 16. As such, any blockages in the chemical injection line 16 caused by hydrate formation is effectively prevented in the system of the present invention.

In the system 10, as shown in FIG. 1 there is a portion 20 of the chemical injection line 16 that extends outwardly from the production piping 14. This portion 20 must extend outwardly of the production piping 14 so as to effectively connect with a junction plate 38. The junction plate 38 will allow the chemical injection line 16 to be connected with a ROV, or other subsea appliance. As such, the suitable chemicals can be delivered to through the chemical injection line 16 toward the manifold 12. In the past, any extensions of the chemical injection line 16 beyond the production piping 14 could still cause the cold contact with the water surrounding the portion 20 of the chemical injection line. The present invention provides a system for preventing any hydrate formations or blockages in this portion 20. As such, the fluid delivery means 18 is incorporated within the system 10 of the present invention so as to prevent blockages in this area.

The fluid delivery means 18 of the present invention has a first conduit 40 that is connected to a receptacle 42. A second conduit 44 is also connected to receptacle 42 is suitable for selective receipt of a hot stab 46 associated with a ROV. The hot stab 46 is in the nature of a conventional hot stab in subsea production. The hot stab 46 of the present invention is connected by a line 48 to a pump 50 and to a heater 52 associated with the ROV. As such, any cool fluids passing through the hot stab 46 can be delivered through the line 48, passed by the pump 50 through the heater 52 and delivered as a heated fluid back to the hot stab 46. It can be seen that the hot stab 46 includes separate orifices 54 and 58. The hot stab 46 serves to deliver the heated fluid from the heater 52 to the first conduit 40. This heated fluid is delivered to the portion 20 of the chemical injection line 16. The hot fluid can then flow through the portion 20 of the chemical injection line 16 so as to pass back to the second conduit 44 as a cooler heated fluid. The cooler heated fluid passing through the second conduit 44 is delivered through orifice 58 of the hot stab 46 back to the line 48. As such, the heater 52 and the pump 50 as located on the ROV, can continuously circulate heated fluid through the portion 20 of the chemical injection line 16. The passing of this heated fluid through the portion 20 of the chemical injection line 16 can serve to remove any blockages caused by hydrate formation in a simple and convenient manner. Once the hot stab 46 is removed from the receptacle 42, the conduits 40 and 44 are effectively closed. This will allow any chemicals to be introduced through the junction plate and into the chemical injection line 16. An insulation material 60 surrounds the portion 20 of the chemical injection line 16. In normal use, the heated fluid that passes through the portion 20 can be in the nature of hot water. The use of the insulation 34 and the insulation 60 serves to increase the heat transfer effects of the production piping to the chemical injection line 16. The chemical injection line 16 is installed onto the production piping 14 prior to the application of the insulation 34. The insulation 60 and 34 surrounds the both the production piping 14 and the chemical injection line 16, respectively. This ensures that the chemical injection line 16 is as close as possible to the production piping 14 so as to maximize heat transfer effects.

As used herein, the subsea piping production 14 can be located in the subsea trees, manifolds, jumpers, or pipeline end terminations, or any other location where chemical injection is required.

Figure 2:
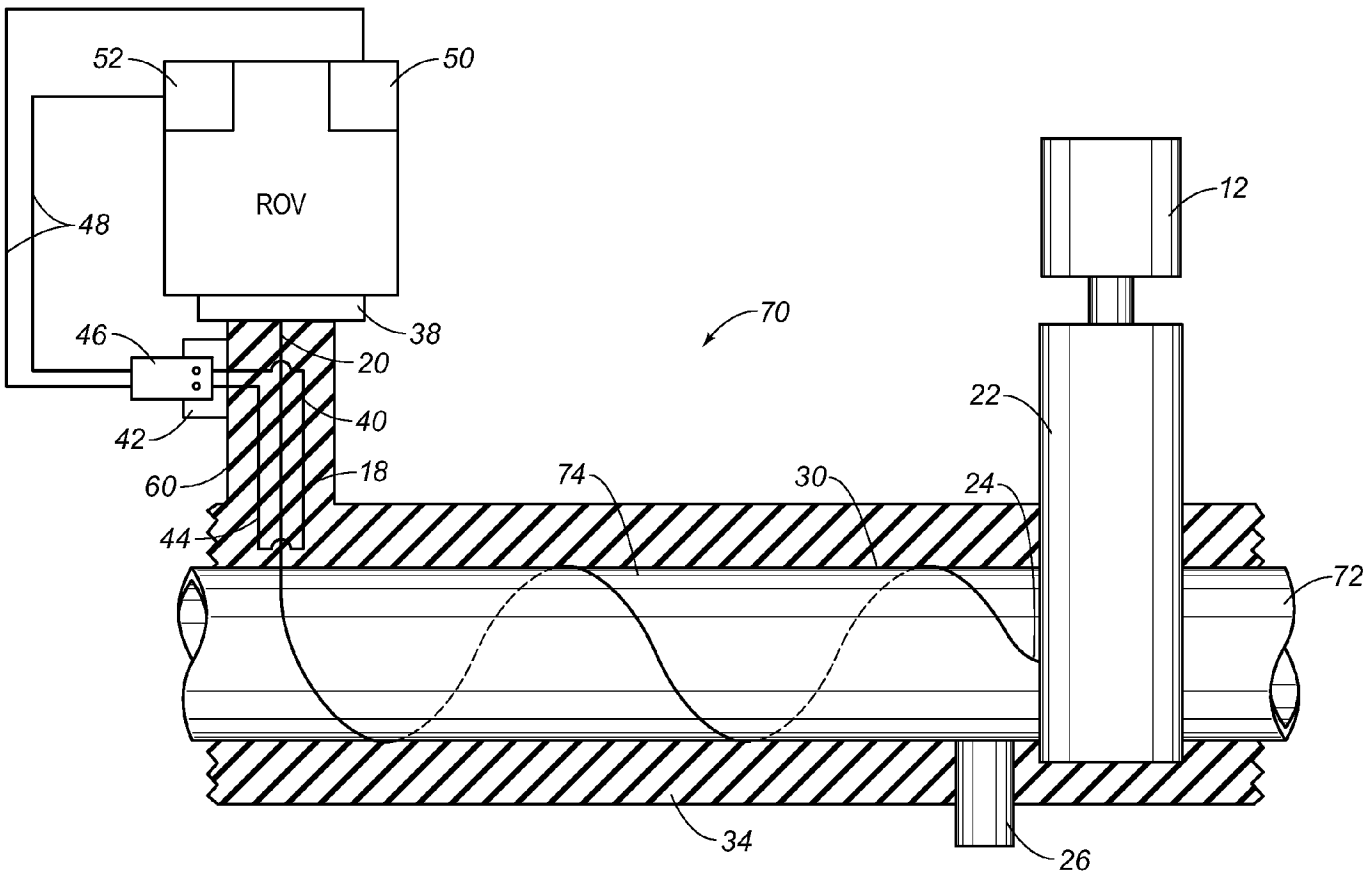
FIG. 2 shows an alternative embodiment of the positioning of the chemical injection line around the production piping in accordance with the system for preventing hydrate formation of the present invention.

FIG. 2 shows an alternative embodiment of the system 70 of the present invention. In FIG. 2, it can be seen that the system 70 includes a production piping 72 having the chemical injection line 74 extending thereover. In FIG. 2, the chemical injection line 74 is wrapped around the production piping 72 in a spiral pattern. Although this spiral pattern of chemical injection line 74 is more difficult to apply to the production piping 72, it does serve to create the requisite high and low points for the trapping of unwanted hydrocarbons. As such, the spiral-wrapped chemical injection line 74 also serves to prevent excessive gas migration into the umbilical system. Suitable check valves can also be incorporated along the chemical injection line 74 to further mitigate hydrocarbon migration.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A system for prevention of hydrate formation comprising:

a manifold;

a subsea production piping communicating with said manifold;

a chemical injection line positioned in heat exchange relationship along said subsea production piping, said chemical injection line extending in a U-shaped pattern over a top surface of said subsea production piping so as to define an elevated portion at said surface and a lower portion extending downwardly from said top surface; and a fluid delivery means connected to said chemical injection line for passing a heated fluid through at least a portion of said chemical injection line.

2. The system of claim 1, said chemical injection line affixed to a surface of said subsea production piping and extending outwardly of said subsea production piping, said fluid delivery means communicating with said second portion of said chemical injection line.

3. The system of claim 2, said fluid delivery means comprising:

a receptacle suitable for connection with a hot stab of an ROV; and a first conduit communicating with said second portion of said chemical injection line at an area adjacent said subsea production piping, said first conduit extending from said receptacle.

4. The system of claim 3, said fluid delivery means comprising:

a second conduit communicating with said second portion of said chemical injection line at a position away from said first conduit, said second conduit extending to said receptacle.

5. The system of claim 2, said chemical injection line extending to a junction plate.

6. The system of claim 2, said chemical injection line having insulation extending thereover.

7. The system of claim 1, said chemical injection line having an end opposite to said fluid delivery means that is connected to a valve adjacent said manifold.

8. A system for prevention of hydrate formation comprising:

a manifold;

a subsea production piping communicating with said manifold;

a chemical injection line positioned in heat exchange relationship along said subsea production piping said chemical injection line extending in a spiral pattern around said subsea production piping; and a fluid delivery means connected to said chemical injection line for passing a heated fluid though at least a portion of said chemical injection line.

9. The system of claim 8, further comprising:

an insulation extending over said subsea production piping and said chemical injection line.

10. A system for preventing hydrate formation comprising:

a subsea production piping having an outer surface; and a chemical injection line affixed to said outer surface of said subsea production piping in heat exchange relation therewith, said chemical injection line extending in a U-shaped pattern over a top surface of said subsea production piping so as to define an elevated portion at said top surface and a lower portion extending downwardly from said top surface.

11. The system of claim 10, further comprising:

a manifold; and a valve positioned between said manifold and said subsea production piping, said chemical injection line connected to said valve at one end thereof.

12. A system for preventing hydrate formation comprising;

a subsea production piping having an outer surface; and a chemical injection line affixed to said outer surface of said subsea production piping in heat exchange relationship therewith, said chemical injection line extending in a spiral pattern around said outer surface of said subsea production piping.

13. The system of claim 12, further comprising:

a fluid delivery means connected to said chemical injection line for passing a heated fluid through at least a portion of said chemical injection line.

14. The system of claim 13, said chemical injection line having a first portion affixed to a surface of said subsea production piping and a second portion extending outwardly of said subsea production piping, said fluid delivery means communicating with said second portion of said chemical injection line.

15. The system of claim 14, said fluid delivery means comprising:

a receptacle suitable for connection with a hot stab of an ROV; and a first conduit communicating with said second portion of said chemical injection line at an area adjacent said subsea production piping, said first conduit extending from said receptacle.

16. The system of claim 15, said fluid delivery means comprising:

a second conduit communicating with said second portion at a position away from said first conduit, said second conduit extending to said receptacle.

* * * * *